United States Patent [19]

Ellenburg et al.

[11] Patent Number: 4,583,513

[45] Date of Patent: Apr. 22, 1986

[54] FOLDABLE WRIST BRACED SLINGSHOT WITH AMMUNITION STORAGE AND DISPENSING MEANS

[76] Inventors: Mark O. Ellenburg, P.O. Box 894, F.D.R., New York, N.Y. 10022; H. Steve Ellenburg, 3468 Iris Ct., Boulder, Colo. 80302

[21] Appl. No.: 563,173

[22] Filed: Dec. 19, 1983

[51] Int. Cl.[4] ..... F41B 3/00

[52] U.S. Cl. ..... 124/20 A; 124/49; 220/244; 220/283; 220/343; 221/306; 222/556

[58] Field of Search ..... 124/20, 45, 49, 50; 222/556, 558; 220/283, 244, 342, 343, 281, 282, 337, 338; 221/206, 306, 303

[56] References Cited

U.S. PATENT DOCUMENTS

| | | | |
|---|---|---|---|
| 257,379 | 5/1882 | Pohlman et al. | 124/20 R |
| 1,430,313 | 9/1922 | Millity | 222/556 X |
| 1,487,973 | 3/1924 | Preston | 124/45 X |
| 3,618,585 | 11/1971 | Allison | 124/20 A |
| 3,718,238 | 2/1973 | Hazard et al. | 222/556 X |
| 4,250,861 | 2/1981 | Ellenberg | 124/20 R |

*Primary Examiner*—Paul E. Shapiro

*Attorney, Agent, or Firm*—Larson and Taylor

[57] ABSTRACT

A folding, wrist braced slingshot having a yolk, a hand grip that stores and dispenses ammunition for use and elastic members connected to said yolk. A wrist brace is frictionally, detachably and pivotably mounted to the hand grip near the base thereof. A pivotable closure means is provided the bottom of the hand grip. The closure swivels to dispense ammunition stored within the hand grip. The yolk comprises a forked portion and a doubled over stem portion wherein the inside base of the stem portion contains a slot and the hand grip contains an inwardly projecting member positioned within said stem portion so that the end thereof fits in said slot.

6 Claims, 5 Drawing Figures

FOLDABLE WRIST BRACED SLINGSHOT WITH AMMUNITION STORAGE AND DISPENSING MEANS

BACKGROUND OF THE INVENTION

1. Field of the Invention

This invention relates to slingshots and more particularly to improved foldable slingshots having a wrist brace.

2. Description of the Prior Art

The earliest slingshots took the form of a handle having a forked element attached or integral therewith. The most common examples of these prior art slingshots and those with which most people are familiar are the slingshots fashioned by youngsters using a crotch cut from the branch of a tree. More sophisticated slingshots of this type have been developed recently, but all suffer from the same disadvantages, foremost of which is lack of accuracy due to the difficulties in holding the wrist steady while shooting. Consequently, there have been developed slingshots that include a wrist brace whose function is to engage the wrist and stabilize the slingshot so that the user can hold it more steady when discharging the shot. Slingshots of the wrist brace variety have taken numerous forms including wrist braced slingshots of the foldable type. The latter, and particularly prior art foldable, wrist braced slingshots having a frictionally and detachably secured wrist brace means have not been entirely satisfactory since most fail to maintain the desired stable, fixed or locked position necessary for accurate shotmaking and are not designed mechanically so that the wrist-brace is attached in such a manner that the hand grip can also be used to store ammunition.

These shortcomings of prior art slingshots were overcome by the foldable slingshot described in U.S. Pat. No. 4,250,861 to Howard Ellenburg. The present invention is an improvement over the slingshot described in this patent.

OBJECTS OF THE INVENTION

It is an object of the present invention to provide all of the advantages of the foldable slingshot described in U.S. Pat. No. 4,250,861 yet offer the additional advantage of being able to store and dispense ammunition for the slingshot in a novel and convenient manner.

Another object of the invention is to provide a foldable slingshot in transportable form characterized by ease of construction even though it carries and dispenses its own ammunition.

SUMMARY OF THE INVENTION

These and other objects of the invention are obtained by a folding slingshot comprising a yolk having a hand grip, elastic members connected to said yolk, wrist brace means frictionally, detachably and pivotably mounted to the hand grip near the base thereof for storing slingshot ammunition therein, a pivotable closure means for closing the bottom of said hand grip, pivot means between said closure means and said hand grip about which said closure means swivels to dispense ammunition from within said hand grip and means on the base of the hand grip for frictionally engaging said closure means to close off the inside of said hand grip. The wrist brace comprises a pair of longitudinal members diverging rearwardly from the hand grip and spaced apart to receive the wrist between them and an end member integral with said longitudinal members engageable with the user's wrist. Stop members on the handle prevent further rotation of the wrist brace.

In a preferred embodiment a groove is placed on each side of said handle near the base thereof to receive end portions of said longitudinal members and a protruding stop member on said hand grip overhangs each of said grooves to prevent further rotation of the wrist brace. A cam area on said hand grip below each of said grooves contains two spaced apart cam surfaces. End portions of the longitudinal members encounter the cam surface upon rotation toward said grooves, thereby spreading slightly said longitudinal members so that after passing over said cam surfaces the end portions of the longitudinal members snap into said grooves and rest against the respective stop members to lock the wrist brace means in shooting position.

BRIEF DESCRIPTION OF THE DRAWINGS

The slingshot of the present invention will be more readily apparent from the accompanying drawings wherein like numerals are employed to designate like parts.

In the Drawings

Figure 1:
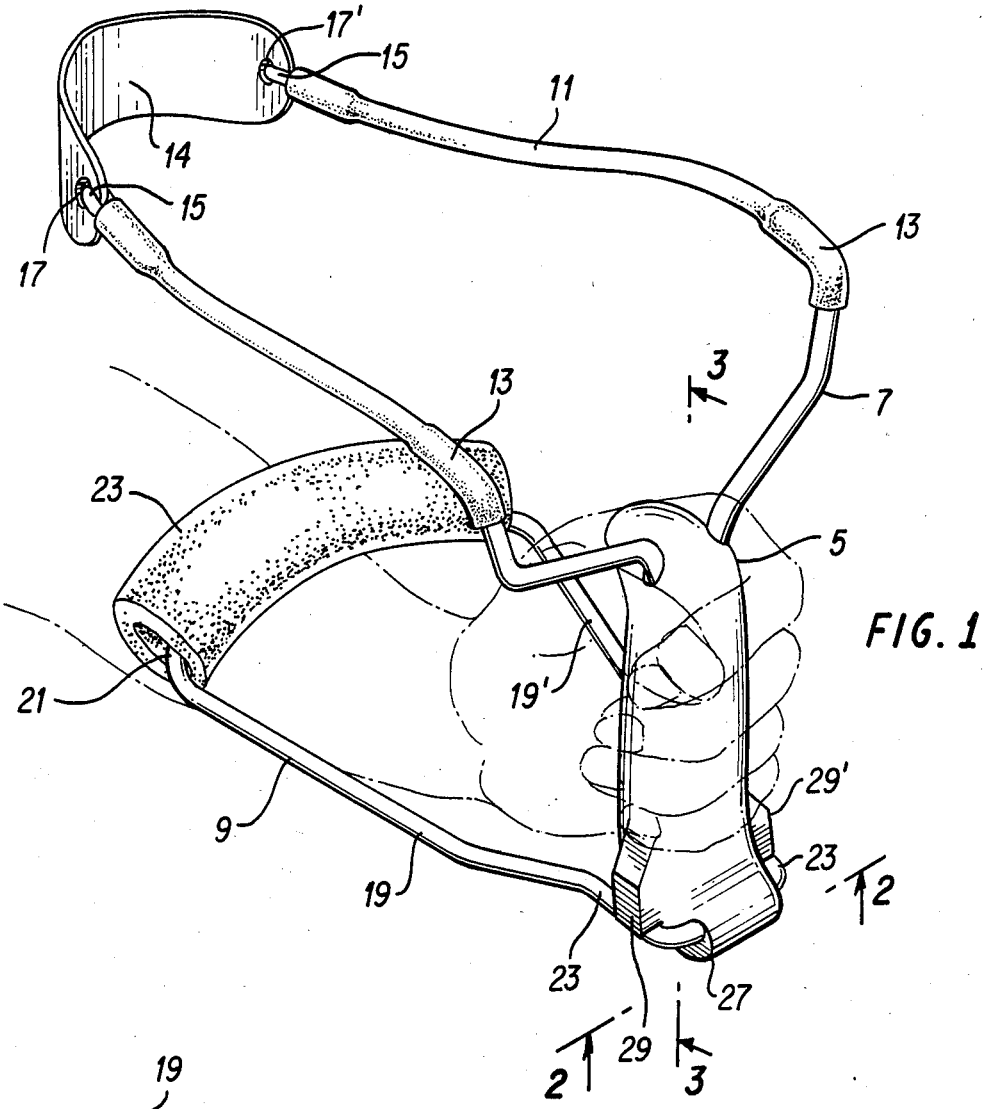
FIG. 1 is perspective of a preferred form of the slingshot of the invention in shooting position.
Figure 2:
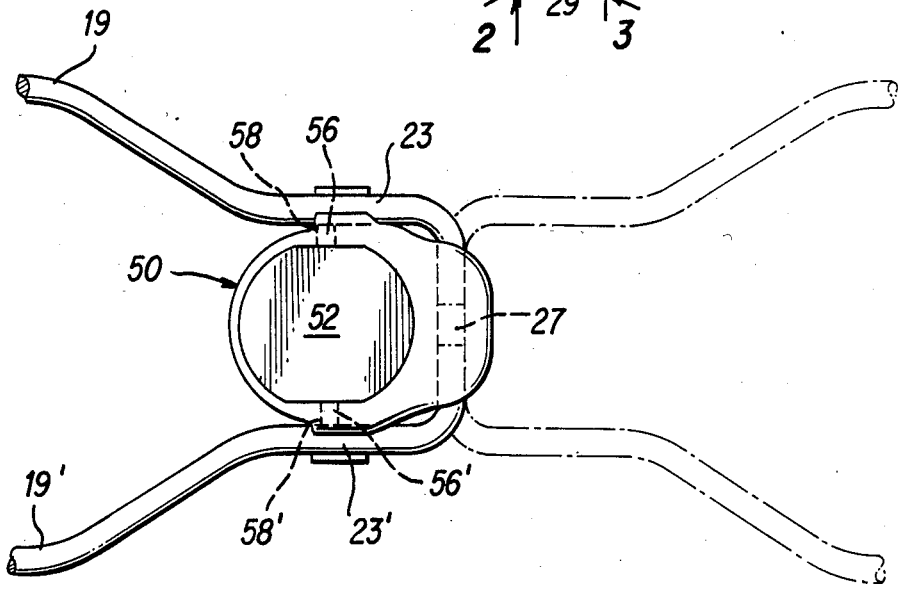
FIG. 2 is a fragmentary bottom plan view of the slingshot shown in FIG. 1.
Figure 3:
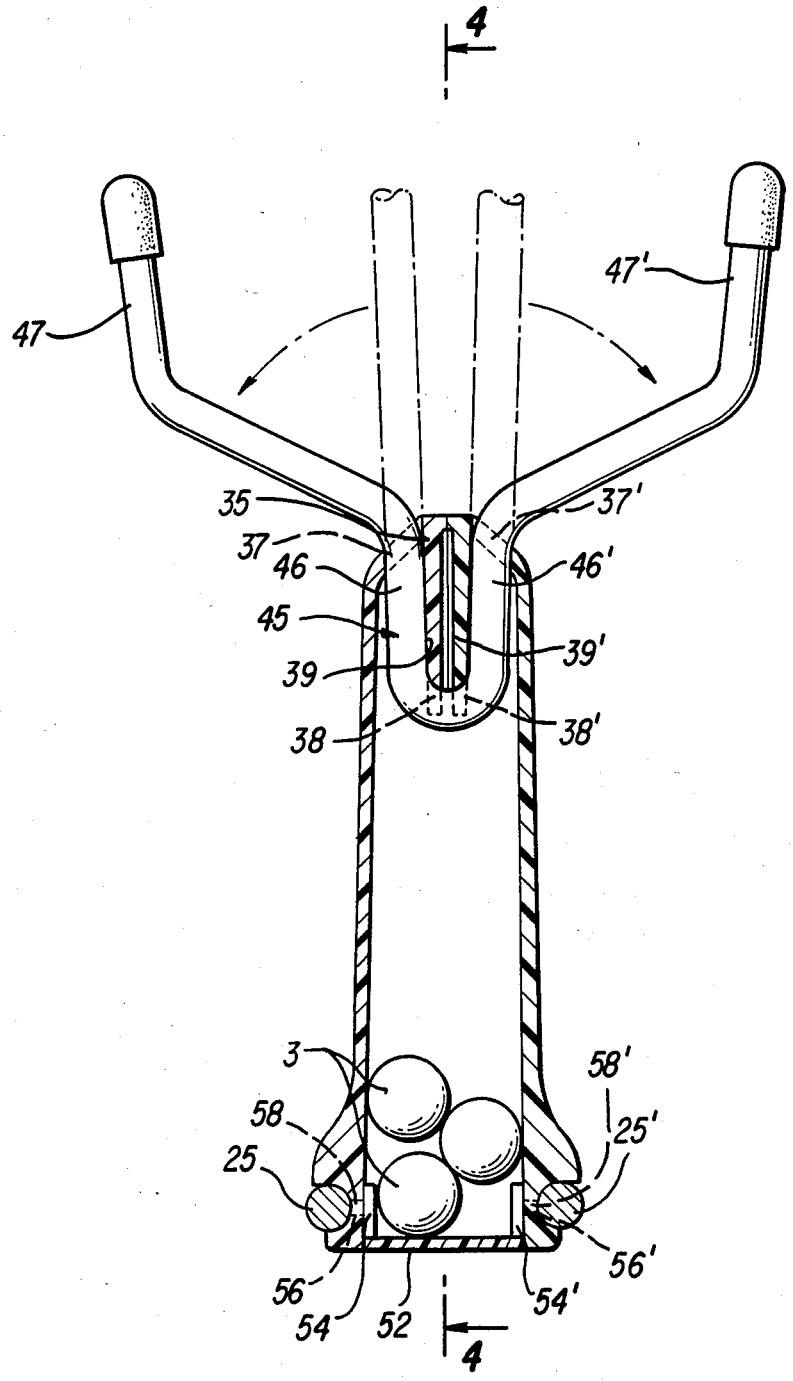
FIG. 3 is a sectional side view of the hand grip taken along line 3—3' of FIG. 1.
Figure 4:
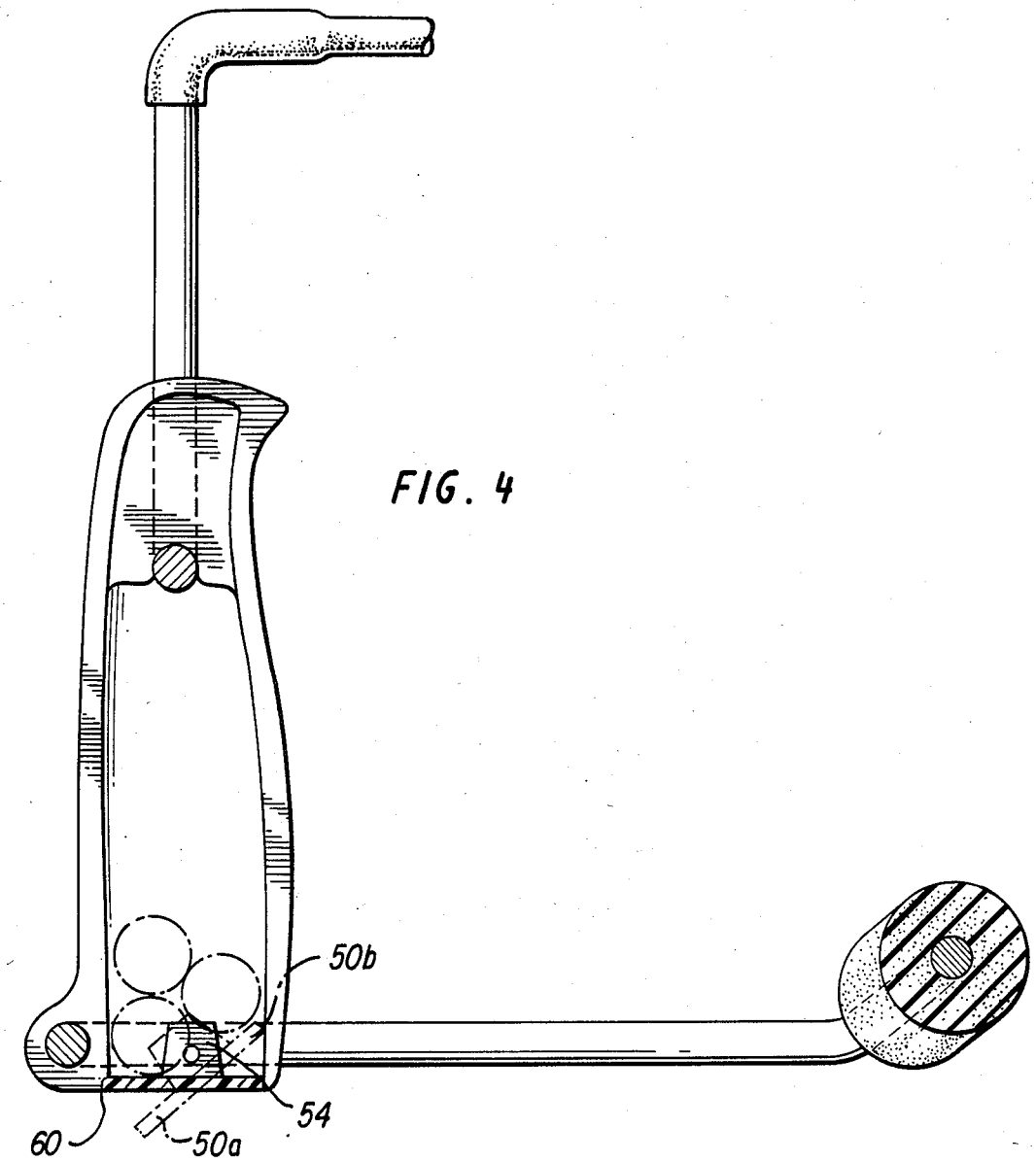
FIG. 4 is a sectional side view of the hand grip taken along line 4—4' of FIG. 3.

Referring now to the drawings and particularly FIG. 1, the hollow hand grip is showing generally as 5, the yoke as 7 and the wrist brace as 9. The hollow hand grip stores ammunition designated 3. (See FIG. 3). An elastic member 11 preferably of rubber tubing is stretched over the bent ends 13 of the yoke 7 and secured thereto by natural friction. Elastic member 11 is provided with a missile pouch 14, preferably of leather. Missile pouch 14 is attached to the elastic member 11 via a slotted plastic plug 15. Attachment of the pouch 13 is effected by slipping a prong of each slotted plug 15 through eyelets 17 and 17' respectively and inserting the plug into the end of elastic tubing 11. The diameter of said plug is preferably larger than the internal diameter of said elastic tubing 11 so as to facilitate attachment by natural friction.

The wrist brace means 9, preferably of a continuous metal rod, is bent so as to comprise two longitudinal members 19 and 19' and an end member 21. Longitudinal members 19, 19' diverge rearwardly and are bent in a fashion permitting receipt of the wrist therebetween. The end member 21 is engageable with the user's wrist and is advantageously provided with a cylindrical cushion member 23 of resilient material such as sponge rubber. Longitudinal members 19, 19' contain end portions 23, 23' essentially parallel to each other, the ends of which portions turn inwardly for mounting onto grooves, 25, 25' (see FIG. 3) and into the openings of hole 27 provided hand grip 5 as will be described in more detail below. End portions 23, 23' of the longitudinal members 19, 19' are overly bent so that when in unmounted position, the distance between end portions 23 and 23′ is less than the distance between the surface of groove 25 and the surface of groove 25′ on hand grip 5. Consequently, when mounted the longitudinal members 19, 19′ will be held against the surface of grooves 25, 25′ respectively by inwardly directed tension.

Figure 5:
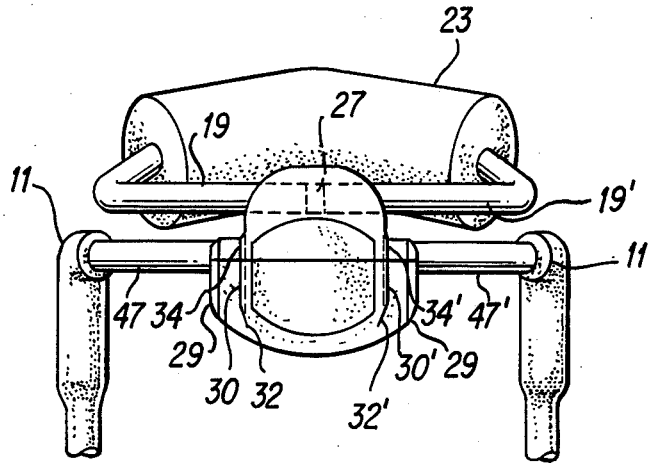
FIG. 5 is a bottom elevational view of the slingshot with the wrist brace means in a folded position.

As aforementioned, the base of handle grip 5 contains two grooves 25 and 25′ on each side of the grip. Preferably the grooves extend from the rear of the hand grip to the ends of hole 27. Hole 27 passes from one side of the hand grip 5 to the other on a line substantially parallel to the bottom of the handle grip 5. Above grooves 25 and 25′ are overhanging stop members 29 and 29′ that advantageously extend the length of the grooves. The size of the grooves is such that they will conveniently accomodate end portions 23 and 23′ of longitudinal members 19 and 19′, respectively. As shown more clearly in FIGS. 3 and 5, cam areas 30 and 30′ are provided beneath grooves 25 and 25′ and each contain two cam surfaces 32, 32′ and 34, 34′.

The hand grip 5 is provided with a forked member 35 comprised of two tooth members 39 and 39′ which project downwardly from the top of the hand grip 5. Yoke 7 can be attached to the hand grip 5 in any suitable manner but in accordance with a preferred embodiment of the invention, yoke 7 is fitted onto hand grip 5 via spaced holes 37 and 37′ in a unique fashion. In accordance with this embodiment of the invention, a straight metal rod is doubled over to form a U-shaped member whose sides 46 and 46′ are spaced apart at distance that enables the U-shaped member to fit closely around forked member 35 and to pass through the holes 37 and 37′. The bottom inside portion of the U-shaped member 35 is provided with slots 38 and 38′ spaced apart a distance which permits receipt of tooth members 39 and 39′ of the fork member 35. The U-shaped member is introduced into the hand grip 5 through its bottom before the hand grip is closed off with closure means 50, so that the ends thereof pass through holes 37 and 37′ and teeth members 39 and 39′ fall into slots 38 and 38′. The protruding portions of the U-shaped member are then bent into fork portions 47, 47′ using any appropriate bending tool and guide means that insures the production of a symmetrical yoke. Once positioned and bent in this manner, yoke 7 will not move either upward, downward or laterally during use.

The closure cap 50 provided the bottom of hand grip 5 has a base 52 and side portions 54 and 54′. Side portions 54 and 54′ each have a pivot stem 56 and 56′ respectively, each of which protrudes laterally thereof and fits into holes 58 and 58′ respectively in hand grip 5 so as to provide a pivot means for closure cap 50. Thus, when closure cap 50 is in closed position, one half 50*a* overlaps the opening at the bottom of the hand grip 5 and snaps into frictional engagement with stop lip 60 provided at the base of hand grip 5 while the other half 50*b* is permitted to swing or pivot inwardly about stems 56 and 56′ upon the application of simple finger pressure. As half of 50*b* swings inwardly, half of 50*a* swings outwardly so as to enable the dispensing of the ammunition.

Wrist brace means 9 is pivotably mounted on hand grip 5 by spreading out the inwardly bent ends of the longitudinal members 19 and inserting them into the openings of the hole 27. Since the wrist brace is overly bent, the inward pressure of the ends of the longitudinal members pivotably mounts the brace on the hand grip 5. Once mounted, the wrist brace 9 can be rotated forward, that is, away from the shooting position, and folded upwardly into contact with the forked portion 47, 47′ of said yoke 7.

When the wrist brace means 19 is rotated forward from a position in direct alignment with the hand grip 5, end portions 23 and 23′ of the longitudinal members 19 and 19′ respectively will first encounter cam surfaces 32 and 32′ and then cam surfaces 34 and 34′. The wrist brace means is spread slightly in passing over cam surfaces 32, 32′ and 34, 34′ and after it passes over the inward tension of the wrist brace means forces or snaps it into grooves 25 and 25′. This prevents counterrotation. At the same moment the end portions 23 and 23′ of the wrist brace means fall in the grooves 25 and 25′, and encounter stop members 29 and 29′ respectively, so that further rotation is precluded. With this placement, the wrist brace means is locked into shooting position.

The foregoing disclosure is representative of preferred forms of the invention and is to be interpreted in an illustrative manner, rather than in a limiting sense, the invention to be accorded the full scope of the claims appended hereto.

It is claimed:

1. A folding slingshot comprising a yoke having a hollow handgrip for storing slingshot ammunition therein, a pivotable closure means for closing off the bottom of said hand grip, means for pivotably mounting said closure means at the bottom of the hand grip such that inward pressure on one end of said closure means provides outward movement of the other end of said closure means from a first, closed position to a second, open position so as to dispense ammunition from within said hand grip, means on the base of said hand grip for frictionally engaging said other end of said closure means in the closed position thereof to close off the inside of said hand grip while preventing inward movement of said other end, wrist brace means frictionally, detachably and pivotably mounted to the hand grip near the base thereof, said wrist brace comprising a pair of longitudinal members diverging rearwardly from the hand grip and spaced apart to receive the wrist therebetween and an end member integral with said longitudinal members engageable with the user's wrist and protruding stop members on said hand grip for preventing further rotation of said wrist brace.

2. The slingshot of claim 1 wherein the closure means is in the form of a snap-on cap having side portions fitting within the hollow hand grip.

3. The slingshot of claim 1 wherein the yolk comprises a continuous bar member bent so as to comprise a forked portion and a doubled over stem portion, said stem portion being positioned and secured within the hand grip.

4. The slingshot of claim 3 wherein the inside base of the stem portion contains a slot and the hand grip contains an inwardly projecting member positioned within said stem portion so that the end thereof fits in said slot.

5. The slingshot of claim 4 wherein the inwardly projecting member is a forked member containing a plurality of teeth members and the inside base of the stem portion contains slots therefor corresponding in number to said teeth into which said teeth fit.

6. The slingshot of claim 1 wherein a groove is provided each side of the handle near the base thereof for receipt of end portions of said longitudinal members, the protruding stop members overhang each of said grooves, a cam area on said hand grip below each of said grooves containing two spaced apart cam surfaces, said end portions of the longitudinal members encountering said cam surfaces successively upon rotation toward said grooves, thereby spreading slightly said longitudinal members so that after passing over said cam surfaces, said end portions of the longitudinal members snap into said grooves and rest against said respective stop members to lock said wrist brace means in shooting position.

* * * * *